US007836546B2

(12) United States Patent
Yoo et al.

(10) Patent No.: US 7,836,546 B2
(45) Date of Patent: Nov. 23, 2010

(54) DUST COLLECTING UNIT FOR VACUUM CLEANER

(75) Inventors: Dong-hun Yoo, Gwangju (KR); Myoung-sun Choung, Gwangju (KR)

(73) Assignee: Samsung Gwangiu Electronics co., Ltd., Gwangju (KR)

( * ) Notice: Subject to any disclaimer, the term of this patent is extended or adjusted under 35 U.S.C. 154(b) by 467 days.

(21) Appl. No.: 12/148,233

(22) Filed: Apr. 17, 2008

(65) Prior Publication Data

US 2009/0100635 A1 Apr. 23, 2009

Related U.S. Application Data

(60) Provisional application No. 61/000,078, filed on Oct. 23, 2007.

(30) Foreign Application Priority Data

Dec. 20, 2007 (KR) ..... 10-2007-0134721

(51) Int. Cl.
*A47L 9/10* (2006.01)

(52) U.S. Cl. ..... 15/352; 15/351; 15/410; 55/337; 55/429; 55/DIG. 3

(58) Field of Classification Search ..... 15/347, 15/350–353; 55/337, 429, DIG. 3; *A47L 9/10*
See application file for complete search history.

(56) References Cited

U.S. PATENT DOCUMENTS 6,732,406 B2 * 5/2004 Oh ..... 15/352
6,735,816 B2 * 5/2004 Oh et al. ..... 15/353
6,782,584 B2 * 8/2004 Choi ..... 15/352
6,991,667 B2 * 1/2006 Yang et al. ..... 55/429
2008/0000044 A1 * 1/2008 Lee ..... 15/352

FOREIGN PATENT DOCUMENTS

EP 1839758 10/2007
EP 1938735 7/2008

(Continued)

OTHER PUBLICATIONS

British Examination Report dated Nov. 24, 2009 corresponding to Application No. GB0815073.2.

(Continued)

*Primary Examiner*—David A Redding
(74) *Attorney, Agent, or Firm*—Ohlandt, Greeley, Ruggiero & Perle, LLP.

(57) ABSTRACT

A dust-collecting unit for a vacuum cleaner is provided which detachably connected with a cleaner body of the vacuum cleaner. The dust-collecting unit includes a dust receptacle which is disposed under a dust separator disposed in the cleaner body, for collecting dust separated from air by the dust separator and dropping down from the dust separator, a dust receptacle ascending/descending part which is disposed under the dust receptacle and is pivoted in a direction or a reverse direction to ascend or descend the dust receptacle and to press-lock or unlock the dust receptacle to or from the dust separator, and a handle which extends from one side of the dust receptacle ascending/descending part along a lengthwise direction of the dust receptacle and has a gap with respect to a circumferential surface of the dust receptacle.

8 Claims, 7 Drawing Sheets

FOREIGN PATENT DOCUMENTS

| | | |
|---|---|---|
| JP | 2001-078938 | 3/2001 |
| JP | 2002-360474 | 12/2002 |
| KR | 1020060061069 | 6/2006 |
| WO | WO 01/35809 | 5/2001 |
| WO | WO 2008/100005 | 8/2008 |

OTHER PUBLICATIONS

British Combined Search and Examination Report dated Dec. 16, 2008 corresponding to Application No. GB0815073.2.

* cited by examiner

DUST COLLECTING UNIT FOR VACUUM CLEANER

CROSS-REFERENCE TO RELATED APPLICATIONS

This application claims the benefit of U.S. Provisional Patent Application No. 61/000,078 filed on Oct. 23, 2007, in the United States Patent and Trademark Office, and of Korean Patent Application No. 10-2007-134721, filed on Dec. 20, 2007, in the Korean Intellectual Property Office, the entire disclosure of both of which are hereby incorporated by reference.

BACKGROUND OF THE INVENTION

1. Field of the Invention

Methods and apparatuses consistent with the present disclosure relate to a vacuum cleaner, and more particularly, to a dust-collecting unit for collecting dust separated from air by a dust separator, which is detachably mounted on a cleaner body, and dropping down from the dust separator.

2. Description of the Related Art

In general, a vacuum cleaner draws in dust-entrained air from a cleaning surface through a suction port assembly body, separates dust from air, and then discharges the cleaned air to the outside and collects the dust in a dust receptacle.

A conventional dust receptacle has a handle formed on a circumference thereof to allow a user to withdraw or carry the dust receptacle from the cleaner body in order to empty it.

However, the handle of the conventional dust receptacle has not achieved an integrated external appearance and has not solved a packaging problem in an economical level. In order to solve these problems, a U-shaped rib which protrudes from a circumference of the dust receptacle to a predetermined height is provided instead of the handle.

However, the rib type handle does not guarantee a stable grip feeling since the user should use his/her finger's tip to grip the rib when the user withdraws the receptacle from the cleaner body or carries it. In particularly, if the user is an older or feeble person who has a weak grip force, it is more difficult for the user to withdraw or carry the dust receptacle.

SUMMARY OF THE INVENTION

Exemplary embodiments of the present disclosure overcome the above disadvantages and other disadvantages not described above. Also, the present disclosure is not required to overcome the disadvantages described above, and an exemplary embodiment of the present disclosure may not overcome any of the problems described above.

An aspect of the present disclosure is to provide a dust-collecting unit for a vacuum cleaner, which satisfies a user's demand for an external appearance of a dust receptacle and also makes it easy to withdraw the dust receptacle from a cleaner body and carry it.

Another aspect of the present disclosure is to provide a dust-collecting unit for a vacuum cleaner, which allows a user to stably press-fit a dust receptacle into a dust separator of a cleaner body using a handle of the dust receptacle.

The foregoing and/or other aspects and utilities of the present disclosure may be achieved by a dust-collecting unit detachably connected with a cleaner body of a vacuum cleaner, the dust-collecting unit including a dust receptacle which is disposed under a dust separator-disposed in the cleaner body, for collecting dust separated from air by the dust separator and dropping down from the dust separator, a dust receptacle ascending/descending part, which is disposed under the dust receptacle and is pivoted in a direction or a reverse direction to ascend or descend the dust receptacle and to press-lock or unlock the dust receptacle to or from the dust separator, and a handle which extends from one side of the dust receptacle ascending/descending part along a lengthwise direction of the dust receptacle and has a gap with respect to a circumferential surface of the dust receptacle.

The dust receptacle ascending/descending part may include a pivoting member that is slidably disposed in an inner circumference of an arc-shaped guide protrusion formed on a side of a bottom of the dust receptacle, and cam-contacts with the bottom of the dust receptacle to ascend or descend the dust receptacle, and an extension member that extends from one side of the pivoting member.

The handle may include a holding member that is disposed parallel with the dust receptacle and has a gap with respect to the dust receptacle, and a connection member that connects the holding member to the extension member.

The guide protrusion may include first and second snap connection recesses that correspond to pivoting positions of the pivoting member in a locked state and a unlocked state, respectively, and the pivoting member may have a snap protrusion formed on a circumference thereof and selectively snap-fitted into the first and the second snap connection recesses to maintain the locked state and the unlocked state of the dust receptacle.

The dust receptacle may have a recess formed on a circumference thereof corresponding to a position where the handle unlocks the dust receptacle, and having a length corresponding to that of the handle.

The dust receptacle ascending/descending part may be pivotably connected with the dust receptacle by first and second fixing pieces secured to a front portion and a rear portion of the bottom of the dust receptacle. The first and the second fixing pieces may have heads for slidably supporting a front portion and a rear portion of the dust receptacle ascending/descending part respectively. The first and the second fixing pieces may be positioned to form a straight line along with the handle with respect to the center of the dust receptacle when the dust receptacle is to be carried.

BRIEF DESCRIPTION OF THE DRAWINGS

Above and other aspects of the present disclosure will become apparent and more readily appreciated from the following description of the exemplary embodiments, taken in conjunction with the accompany drawings of which.

DETAILED DESCRIPTION OF EXEMPLARY EMBODIMENTS

Figure 1:
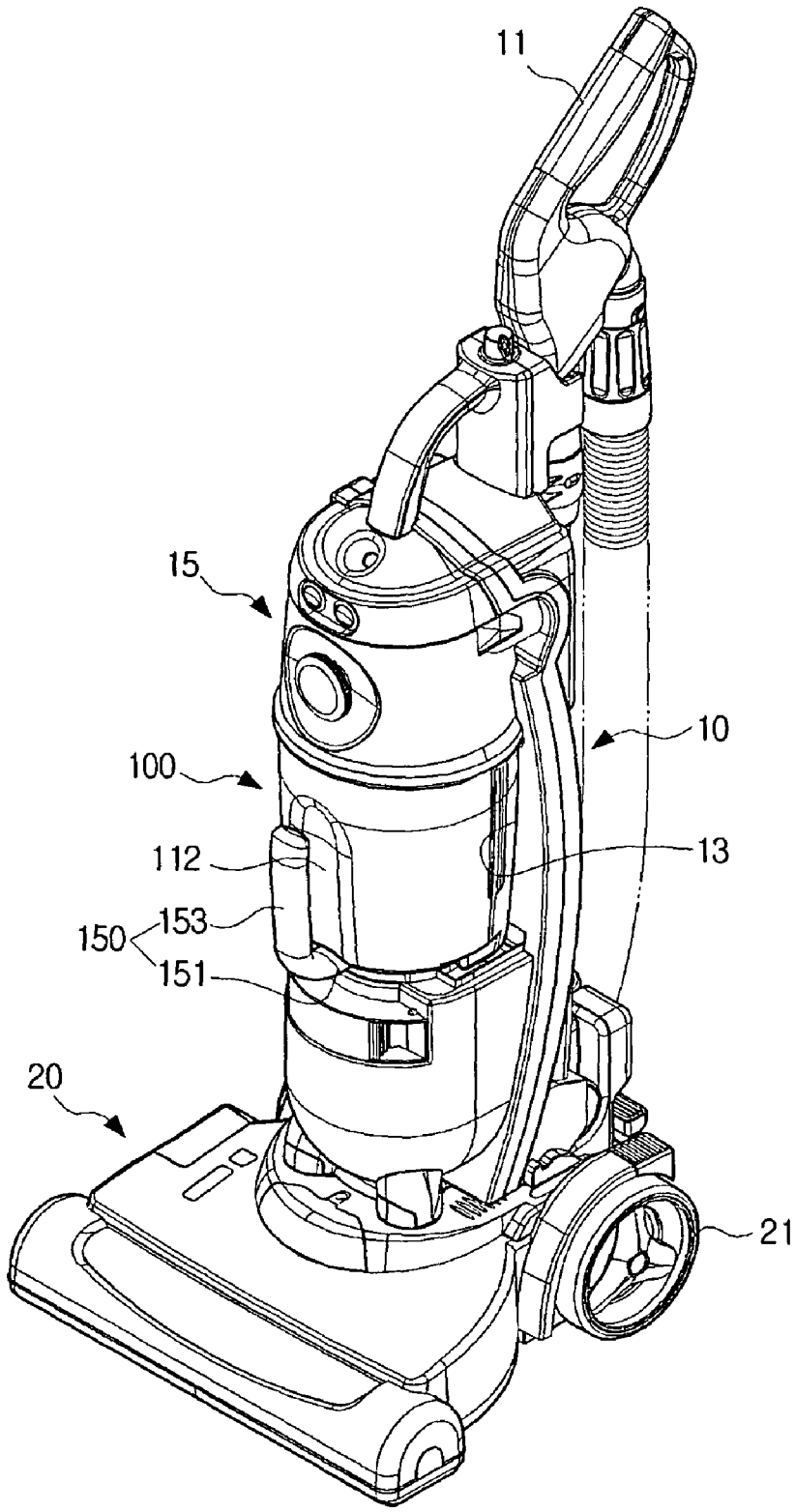
FIG. 1 is a perspective view illustrating a dust-collecting unit which is mounted on a cleaner body according to an exemplary embodiment of the present disclosure.

Certain exemplary embodiments of the present disclosure will be described in greater detail with reference to the accompanying drawings.

In the following description, the same drawing reference numerals are used for the same elements even in different drawings. The matter defined in the description, such as detailed construction and elements, are provided to assist in a comprehensive understanding of the disclosure. Thus, it is apparent that the exemplary embodiments of the present disclosure can be carried out without this specifically defined matter. Also, well-known functions or constructions are not described in detail since they would obscure the disclosure with unnecessary detail.

Figure 2:
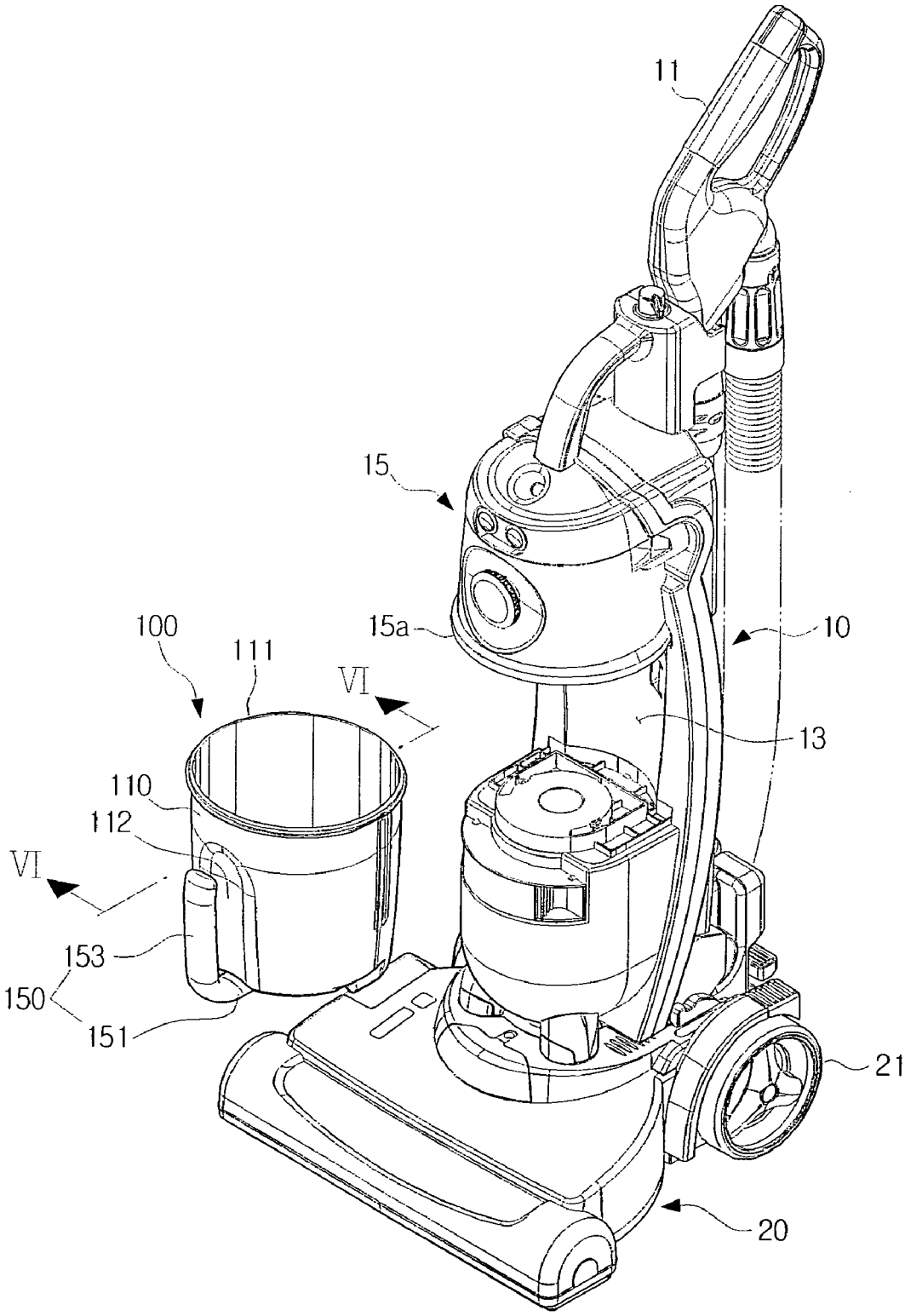
FIG. 2 is a perspective view illustrating the dust-collecting unit which is dismounted from the cleaner body according to the exemplary embodiment of the present disclosure.
Figure 3:
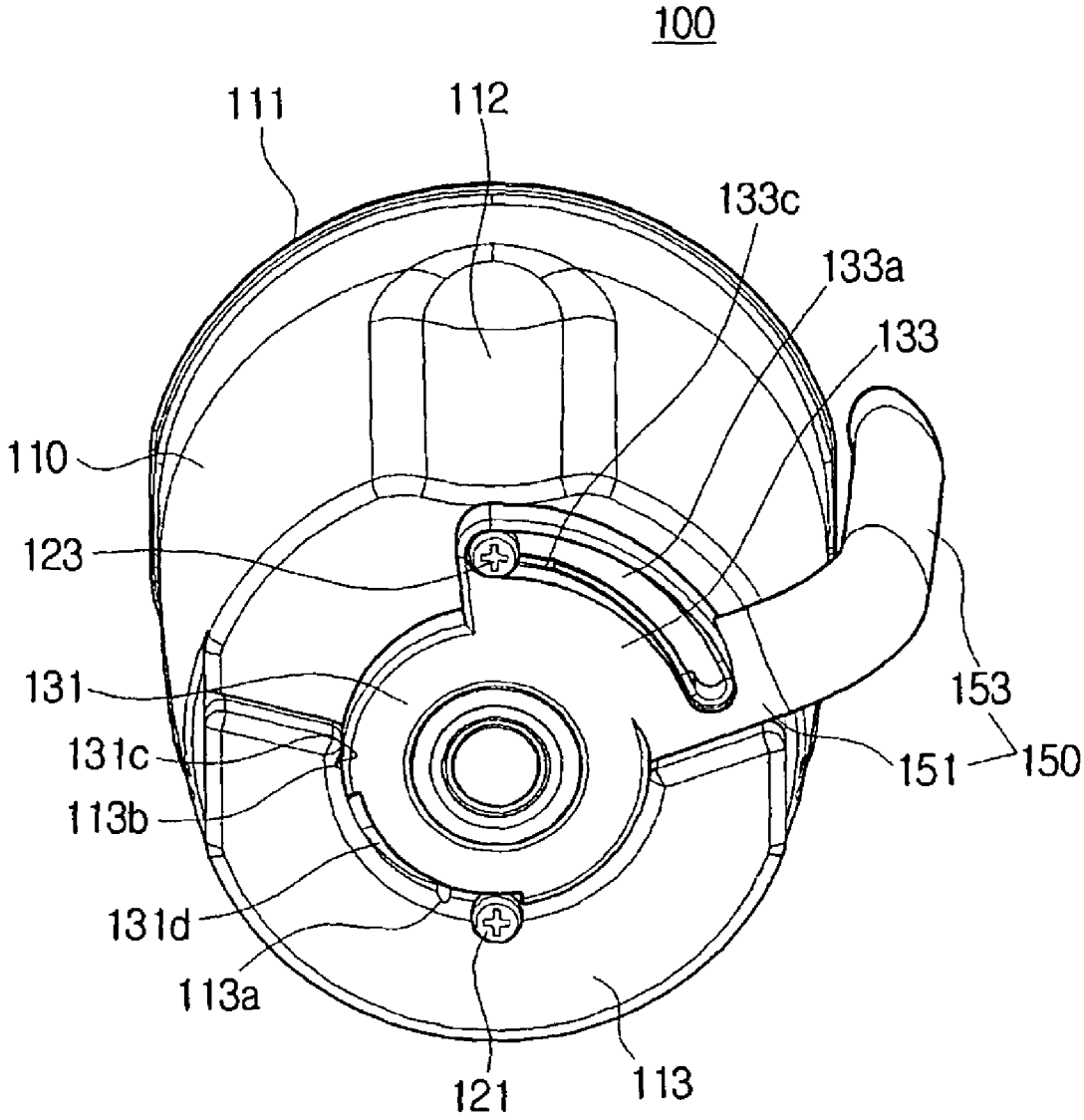
FIG. 3 is a perspective view illustrating the dust-collecting unit for a vacuum cleaner according to the exemplary embodiment of the present disclosure
Figure 4:
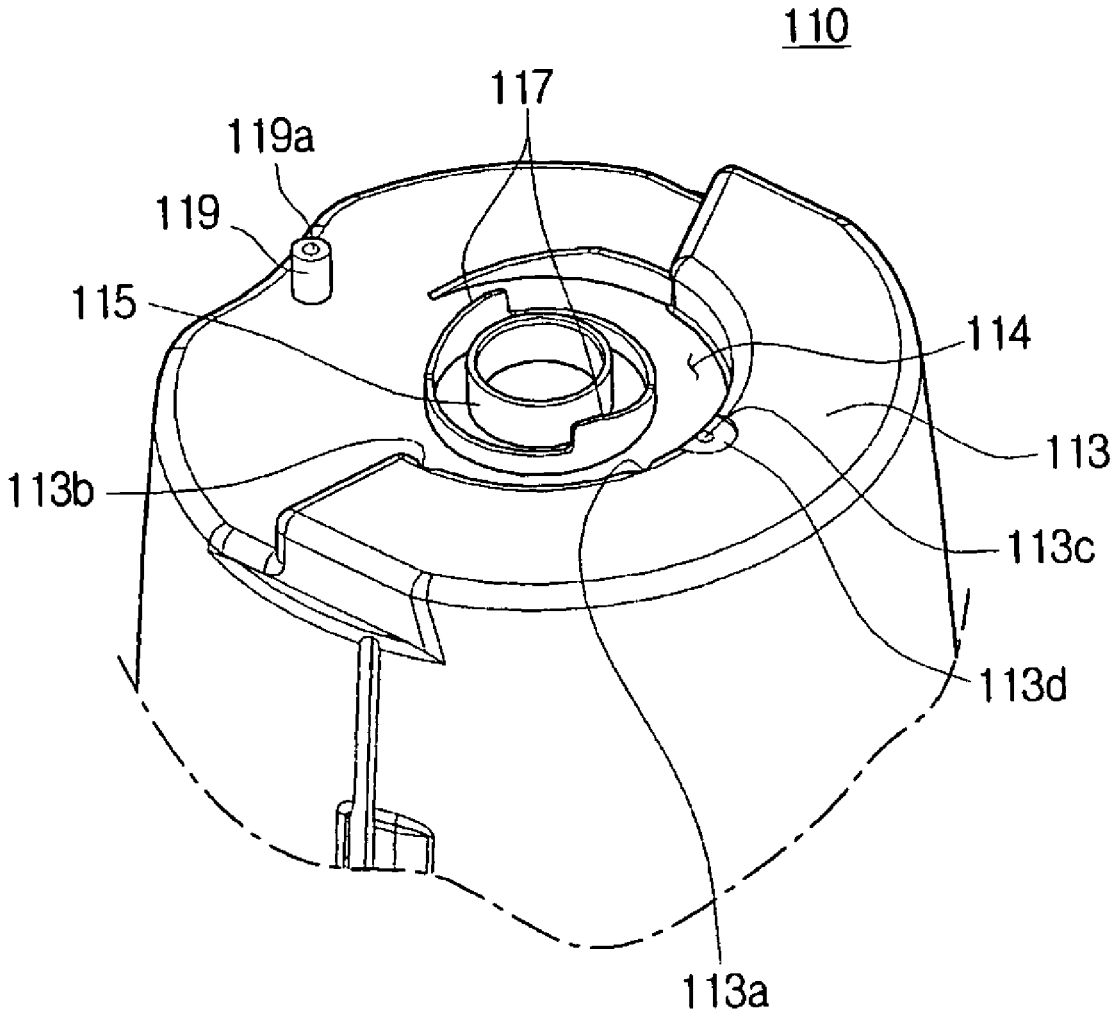
FIG. 4 is a perspective view illustrating a dust receptacle of the dust-collecting unit of FIG. 3.
Figure 5:
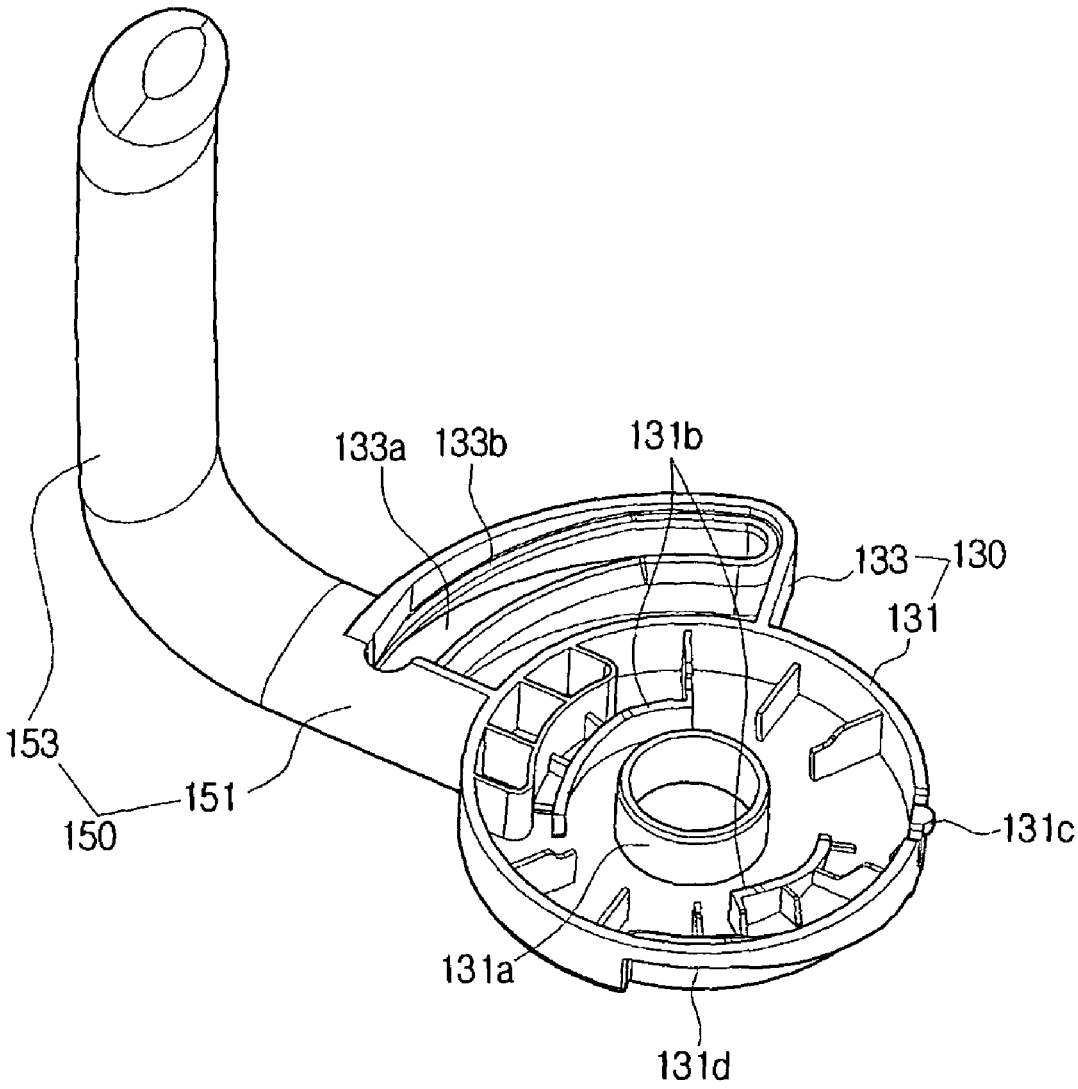
FIG. 5 is a perspective view illustrating a dust receptacle ascending/descending part and a handle of the dust-collecting unit of FIG. 3.

A vacuum cleaner according to an exemplary embodiment of the present disclosure comprises a cleaner body 10, a suction port assembly body 20, and a dust-collecting unit 100 is shown in FIGS. 1 and 2.

The cleaner body 10 has a motor (not shown) embedded in a lower inner portion thereof to generate a vacuum pressure between the suction port assembly body 20 and a cleaning surface. Also, the cleaner body 10 has a manipulation handle 11 formed on an upper end thereof to allow a user to freely move and manipulate the vacuum cleaner during a cleaning operation. Also, the cleaner body 10 has a receiving part 13 formed in a middle portion thereof to mount the dust-collecting unit 100 therein, and a dust separator 15 disposed above the receiving part 13 to separate dust from air using a cyclone.

The suction port assembly body 20 is hinged on a lower end of the cleaner body 10 and has a suction port (not shown) formed on a bottom thereof to draw in dust-entrained air from the cleaning surface therethrough. Wheels 21 are disposed at rear opposite sides of the suction port assembly body 20 to make the suction port body assembly body 20 travel on the cleaning surface smoothly.

In this embodiment, the dust-collecting unit 100 is applied to a general upright type vacuum cleaner where the cleaner body 10 is assembled with the suction port assembly body 20, by way of an example. However, this should not be considered as limiting. The dust-collecting unit 100 can be applied to a split type vacuum cleaner in which the suction port assembly body 20 and the cleaner body 10 can be separated from each other to enable the user to use the cleaner body 10 only for a cleaning operation.

The dust-collecting unit 100 comprises a dust receptacle 110, a dust receptacle ascending/descending part 130, and a handle 150, and will be described in detail with reference to FIGS. 3 to 6.

The dust receptacle 110 is fluidly communicated with a lower side of the dust separator 15 and has an opened top and a closed bottom to collect dust that has been separated from the air in the dust separator 15 and drops down from the dust separator 15 in a gravity direction. The dust receptacle 110 has an upper edge 111 having a diameter corresponding to that of a lower edge 15*a* of the dust separator 15 (see FIG. 2) such that the dust receptacle 110 is press-fitted onto the lower edge 15*a* of the dust separator 15. The dust receptacle 110 has a recess 112 formed on a circumference thereof along a lengthwise direction of the dust receptacle 110. The recess 112 broadens a gap between the handle 150 and the dust receptacle 110 and thus allows the user to easily grasp the handle 150 when the user carries the dust-collecting unit 100.

Also, the dust receptacle 110 has a guide protrusion 113 formed on an outer surface of a bottom of the dust receptacle 10 along a circumferential direction of the dust receptacle 110 in a substantially arc shape in order to pivotably support the dust receptacle ascending/descending part 130. The length of the guide protrusion 113 may be determined in consideration of a pivoting angle of the dust receptacle ascending/descending part 130. Also, the guide protrusion 113 has a depression portion 114 formed in a center thereof to allow the dust receptacle ascending/descending part 130 to slidably contact therewith, and has a first and a second snap connection recesses 113*a* and 113*b* formed along an inner circumference of the guide protrusion 113 at a predetermined interval. The interval between the first and the second snap connection recesses 113*a* and 113*b* is set such that the handle 150 switches between a position to lock the dust receptacle 110 into the dust separator 15 and a position to unlock the dust receptacle 110 from the dust separator 15.

Furthermore, the guide protrusion 113 has a connection hole 113*c* to which a first fixing piece 121 (see FIG. 6) is secured to prevent the dust receptacle ascending/descending part 130 from being separated from the dust receptacle 110. A head seating recess 113*d* to which a head of the first fixing piece 121 is inserted is formed around the connection hole 113*c*.

Also, the dust receptacle 110 has a boss 119 protruding from a side opposing the guide protrusion 113 to a predetermined height, and the boss 119 has a connection hole 119*a* to which a second fixing piece 123 (see FIG. 6) is secured. The dust receptacle 110 has a first connection part 115 formed on a center of the bottom thereof in a cylindrical shape, and a pair of first cam ribs 117 which is eccentric with the first connection part 115 and symmetrical with each other is formed along a circumference having a diameter larger than that of the first connection part 115, and each first cam rib 117 is inclined to one side. Each end of the pair of first cam ribs 117 has a phase difference corresponding to an ascending/descending distance of the dust receptacle 110.

The dust receptacle ascending/descending part 130 comprises a pivoting member 131 and an extension member 133.

The pivoting member 131 has a diameter corresponding to the inner circumference of the guide protrusion 113 such that the pivoting member 131 is inserted into the depression portion 114 and its outer circumferential part slidably contacts with the inner circumference of the guide protrusion 113. Also, the pivoting member 131 has a second connection part 131*a* inserted into the first connection part 115 of the dust receptacle 110, and a pair of second cam ribs 131*b* which are concentric with the second connection part 131*a*, are formed along a circumference having a diameter corresponding to that of the pair of first cam ribs 117, and are inclined toward one side. Accordingly, the pivoting member 131 is concentric with the center of the bottom of the dust receptacle 110 and is pivotable on the center of the dust receptacle 110.

The pair of second cam ribs 131*b* are inclined in an opposite direction to that of the pair of first cam ribs 117 of the dust receptacle 110, and their ends have a phase difference corresponding to the ascending/descending distance of the dust receptacle 110 like the pair of first cam ribs 117. Accordingly, if the dust receptacle ascending/descending part 130 is engaged with the dust receptacle 110, inclined surfaces the pairs of the first an the second cam ribs 117 and 131*b* correspond to each other, and thus, if the dust receptacle ascending/descending part 130 pivots in one direction or the reverse direction, the dust receptacle 110 ascends and descends due to the cam operations of the first and the second cam ribs 117, 131*b*.

Also, the pivoting member 131 has a snap protrusion 131*c* formed on a circumference thereof and selectively snap-fitted into the first and the second snap connection recesses 113*a*, 113*b* of the guide protrusion 113. The snap protrusion 131*c* is resiliently snap-fitted into the first or the second snap connection recess 113*a*, 113*b* to maintain the unlocked state and the locked state of the handle 150, and also prohibits the pivotal movement of the dust receptacle ascending/descending part 130. Also, the snap protrusion 131*c* generates a sound when being snap-fitted into the first or the second snap connection recess 113*a*, 113*b* and accordingly auditorily informs the user that the dust receptacle ascending/descending part 130 completes its operation.

The pivoting member 131 has a first inclined recess 131*d* formed along a circumference thereof and having a length corresponding to a pivotal angle of the dust receptacle ascending/descending part 130. The first inclined recess 31*d* continues to slidably support the head of the first fixing piece 121 even when the dust receptacle ascending/descending part 130 pivots. Accordingly, even if a radial clearance occurs between the bottom of the dust receptacle 110 and the pivoting member 131 the dust receptacle 110 can safely ascend and/or descend without being shaken. Also, the first inclined recess 131*d* prevents the pivoting member 131 from being completely separated from the dust receptacle 110 in association with the first fixing piece 121.

The extension member 133 extends from one side of the pivoting member 131 and has an arc guide hole 133*a* formed on a free end of the extension member 133 from a position corresponding to the boss 119 along a circumferential direction with respect to a center of the pivoting member 131. The guide hole 133*a* has a length corresponding to the pivoting angle of the dust receptacle ascending/descending part 130.

Also, the extension member 133 has a second inclined protrusion 133*b* formed along the guide hole 133*a* and facing the bottom of the dust receptacle 110, and a release prevention protrusion 133*c* formed opposite the second inclined protrusion 133*b* along the guide hole 133*a*. The second inclined protrusion 133*b* continues to contact with a leading end of the boss 119 when the dust receptacle ascending/descending part 130 pivots, and thus, if a radical clearance occurs between the bottom of the dust receptacle 110 and the extension member 133, the dust receptacle 110 can ascend and/or descend without being shaken. Accordingly, the dust receptacle ascending/descending part 130 is slidably pivoted on the bottom of the dust receptacle 110 but is stable due to the presence of the first and the second fixing pieces 121, 123.

The handle 150 comprises a connection member 151 extending from a free end of the extension member 133 on the same plane as the extension member 133, and a holding member 153 extending from the connection member 151 and bending in a perpendicular direction with respect to the connection member 151. The holding member 153 is in a parallel relation with respect to an outer circumference of the dust receptacle 110 with a predetermined gap when the dust receptacle ascending/descending part 130 is mounted under the dust receptacle 110. With this structure, the handle 150 aids the user to easily carry the dust receptacle 110 and also locks and unlocks the dust receptacle 110 to and from the dust separator 15 by pivoting the dust receptacle ascending/descending part 130.

Figure 6:
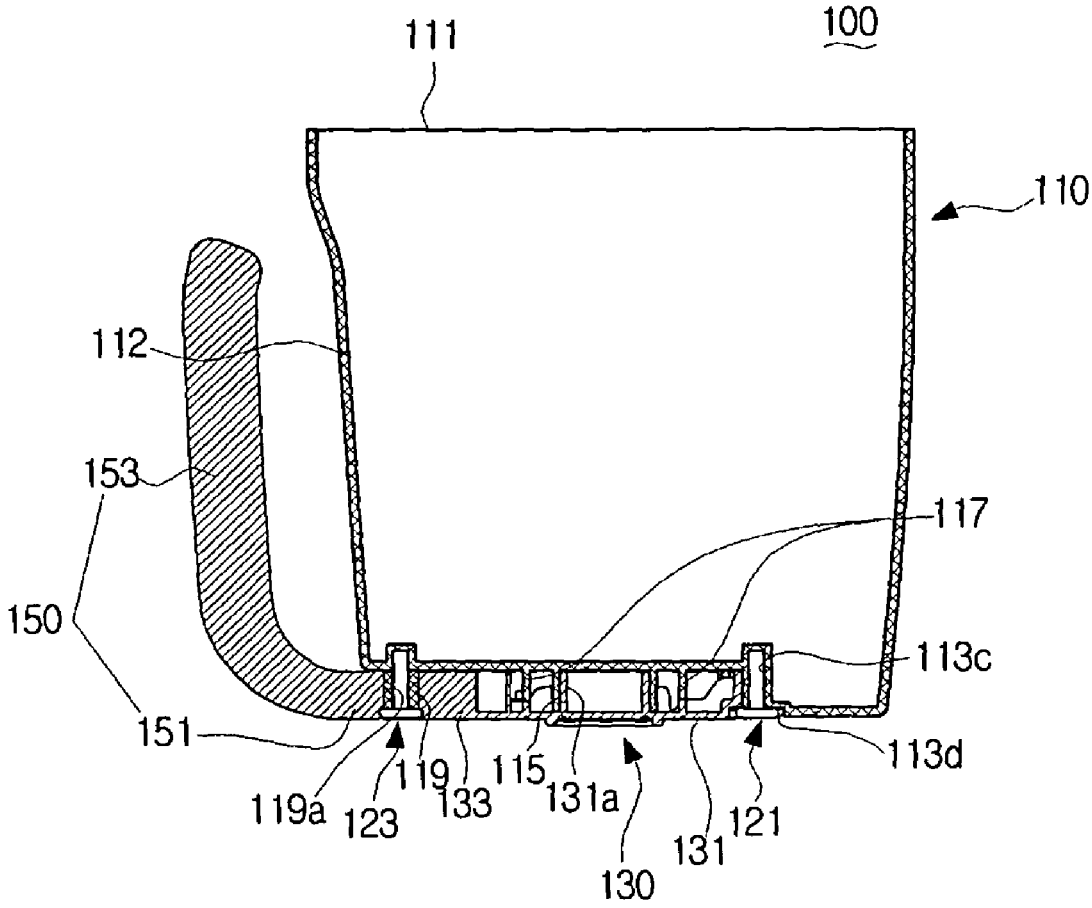
FIG. 6 is a cross-section view illustrating the dust-collecting unit, which is taken along line VI-VI of FIG. 2.

Also, as shown in FIG. 6, when the dust receptacle 110 is to be carried, the handle 150 is positioned to form a straight line along with the first and the second fixing pieces 121, 123 for supporting the dust receptacle 110 at the front and rear sides with respect to the center of the dust receptacle 110, thereby guaranteeing a stability.

Hereinafter, operation of the dust-collecting unit 100 as described above according to the exemplary embodiment of the present disclosure will now be described.

First, the dust receptacle 110 is press-locked into the lower end 15*a* of the dust separator 15. More specifically, the dust-collecting unit 100 is mounted in the receiving part 13 of the cleaner body 10.

Figure 7:
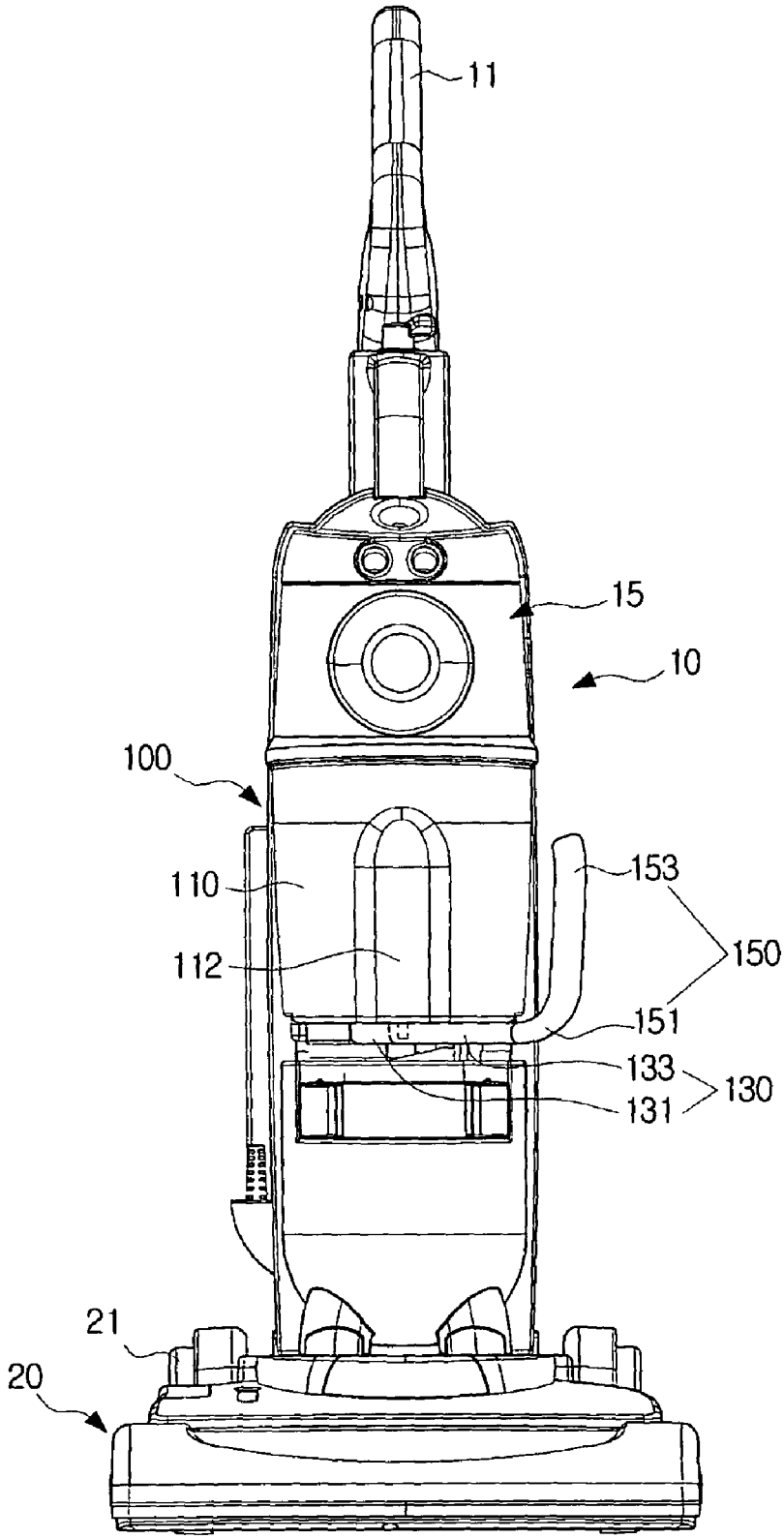
FIG. 7 is a front view illustrating the dust receptacle when press-fit into a dust separator according to the exemplary embodiment of the present disclosure.

Next, if the handle 150 is pivoted in one direction of the cleaner body 10 using the holding member 153 of the handle 150 located on a front portion of the cleaner body 10 as shown in FIG. 7, the pivoting member 131 of the dust receptacle ascending/descending part 130 is pivoted in one direction such that the snap protrusion 131*c* of the pivoting member 131 is released from the first snap connection recess 113*a* of the guide protrusion 113 and the pair of second cam ribs 131*b* slidably pivot along the inclined surfaces of the pair of first cam ribs 117 of the dust receptacle 110.

Accordingly, the dust receptacle 110 ascends, and, if the handle 150 is pivoted until the snap protrusion 131*c* is snap-fitted into the second snap connection recess 113*b*, the upper edge 111 of the dust receptacle 110 is press-fitted over the lower edge 15*a* of the dust separator 15.

In this state, the user performs a cleaning operation, and, in order to empty the dust receptacle 110 after cleaning, the handle 150 is pivoted in a reverse direction such that the snap protrusion 131*c* is released from the second snap connection recess 113*b* and snap-fitted into the first snap connection recess 113*a*.

Simultaneously, the second cam ribs 131*b* are pivoted along with the pivoting member 131 in the reverse direction and slide along the inclined surfaces of the first cam ribs 117 of the dust receptacle 110 such that the dust receptacle 110 descends and the upper edge 111 of the dust receptacle 110 is released from the lower edge 15*a* of the dust separator 15.

Since the handle 150 is located corresponding to the recess 112 of the dust receptacle 110, the user inserts his/her finger between the recess 112 and the handle 150 and holds the holding member 153 of the handle 150. Then, the user withdraws the dust receptacle 110 from the receiving part 13 of the cleaner body 10 and carries the dust receptacle 110 to empty it.

As described above, according to the exemplary embodiment of the present disclosure, the handle 150 extends from the dust receptacle ascending/descending part 130, thereby serving to ascend and/or descend the dust receptacle 110 toward and/or from the dust separator 15 and also aiding the user to withdraw the dust receptacle 110 from the cleaner and carry it. Accordingly, a user's convenience can be improved.

Also, when the dust receptacle 110 is locked into the dust separator 15, the handle 150 is positioned toward a side of the cleaner body. Accordingly, compared to a conventional cleaner where a handle is always positioned on a front side of the cleaner, the handle is not caught in a surrounding obstacle or user's clothing and thus does not hinder the cleaning operation. Also, conventional problems in view of external appearance and packaging can be solved The foregoing exemplary embodiments and advantages are merely exemplary and are not to be construed as limiting the present disclosure. The present teaching can be readily applied to other types of apparatuses. Also, the description of the exemplary embodiments of the present disclosure is intended to be illustrative, and not to limit the scope of the claims, and many alternatives, modifications, and variations will be apparent to those skilled in the art.

What is claimed is:

1. A dust-collecting unit detachably connected with a cleaner body of a vacuum cleaner, the dust-collecting unit comprising:

a dust receptacle which is disposed under a dust separator disposed in the cleaner body, the dust receptacle collecting dust separated from air by the dust separator and dropping down from the dust separator;

a dust receptacle ascending/descending part which is disposed under the dust receptacle and is pivoted in a direction or a reverse direction to ascend or descend the dust receptacle and to press-lock or unlock the dust receptacle to or from the dust separator; and a handle which extends from one side of the dust receptacle ascending/descending part along a lengthwise direction of the dust receptacle and has a gap with respect to a circumferential surface of the dust receptacle.

2. The dust-collecting unit as claimed in claim 1, wherein the dust receptacle ascending/descending part comprises:

a pivoting member which is slidably disposed in an inner circumference of an arc-shaped guide protrusion formed on a side of a bottom of the dust receptacle, and cam-contacts with the bottom of the dust receptacle to ascend or descend the dust receptacle; and an extension member which extends from one side of the pivoting member.

3. The dust-collecting unit as claimed in claim 2, wherein the handle comprises:

a holding member which is disposed parallel with the dust receptacle and has the gap with respect to the circumferential surface of the dust receptacle; and a connection member which connects the holding member to the extension member.

4. The dust-collecting unit as claimed in claim 2, wherein the arc-shaped guide protrusion comprises first and second snap connection recesses which correspond to pivoting positions of the pivoting member in a locked state and a unlocked state, respectively, and wherein the pivoting member has a snap protrusion which is formed on a circumference thereof and selectively snap-fitted into the first and the second snap connection recesses to maintain the locked state and the unlocked state of the dust receptacle, respectively.

5. The dust-collecting unit as claimed in claim 2, wherein the dust receptacle has a recess formed on a circumference thereof corresponding to a position where the handle unlocks the dust receptacle, and having a length corresponding to that of the handle.

6. The dust-collecting unit as claimed in claim 1, wherein the dust receptacle ascending/descending part is pivotably connected with the dust receptacle by first and second fixing pieces secured to a front portion and a rear portion of the bottom of the dust receptacle, respectively.

7. The dust-collecting unit as claimed in claim 6, wherein the first and the second fixing pieces each have a head for slidably supporting the dust receptacle ascending/descending part.

8. The dust-collecting unit as claimed in claim 6, wherein the first and the second fixing pieces are positioned to form a straight line along with the handle with respect to a center of the dust receptacle when the dust receptacle is to be carried.

* * * * *